US005342817A

United States Patent [19]

Sarraf

[11] Patent Number: 5,342,817

[45] Date of Patent: * Aug. 30, 1994

[54] NONCONTACT DONOR AND RECEIVER HOLDER FOR THERMAL PRINTING

[75] Inventor: Sanwal P. Sarraf, Webster, N.Y.

[73] Assignee: Eastman Kodak Company, Rochester, N.Y.

[ * ] Notice: The portion of the term of this patent subsequent to Aug. 10, 2010 has been disclaimed.

[21] Appl. No.: 906,197

[22] Filed: Jun. 29, 1992

[51] Int. Cl.[5] ..... B41M 5/035; B41M 5/38

[52] U.S. Cl. ..... 503/227; 346/76 L; 428/13; 428/14; 428/192; 428/195; 428/913; 428/914; 430/200; 430/945

[58] Field of Search ..... 8/471; 428/13, 14, 192, 428/195, 913, 914; 430/200, 945; 503/227; 346/76 L

[56] References Cited

U.S. PATENT DOCUMENTS

| | | | |
|---|---|---|---|
| 2,572,640 | 10/1951 | Lovegrove | 248/362 |
| 3,588,079 | 6/1971 | Addy et al. | 269/21 |
| 3,655,379 | 4/1972 | Gundlach | 96/27 |
| 3,745,586 | 7/1973 | Braudy | 346/76 |
| 4,772,582 | 9/1988 | DeBoer | 503/227 |
| 4,804,975 | 2/1989 | Yip | 346/76 L |
| 4,865,949 | 9/1989 | Yamamurd et al. | 430/272 |
| 4,902,669 | 2/1990 | Matsuda et al. | 503/227 |
| 4,916,112 | 4/1990 | Henzel et al. | 503/227 |
| 4,985,289 | 1/1991 | Kamezaki et al. | 428/64 |
| 5,017,547 | 5/1991 | DeBoer | 503/227 |
| 5,053,791 | 10/1991 | Baek et al. | 346/138 |
| 5,234,886 | 8/1993 | Sarraf et al. | 503/227 |

*Primary Examiner*—B. Hamilton Hess
*Attorney, Agent, or Firm*—Dennis R. Arndt

[57] ABSTRACT

An apparatus and method are provided for forming a laser induced thermal dye transfer. The apparatus includes a dye receiving element having a ridge formed along a periphery thereof for receiving a dye donor element thereon with the only physical contact between the elements occurring along the ridge. Separation between the donor and receiver elements is maintained by the ridge by mounting the donor and receiver against mounting plates that hold the elements flat. A vacuum is applied to the holding plates to attract the elements towards their respective holders.

11 Claims, 1 Drawing Sheet

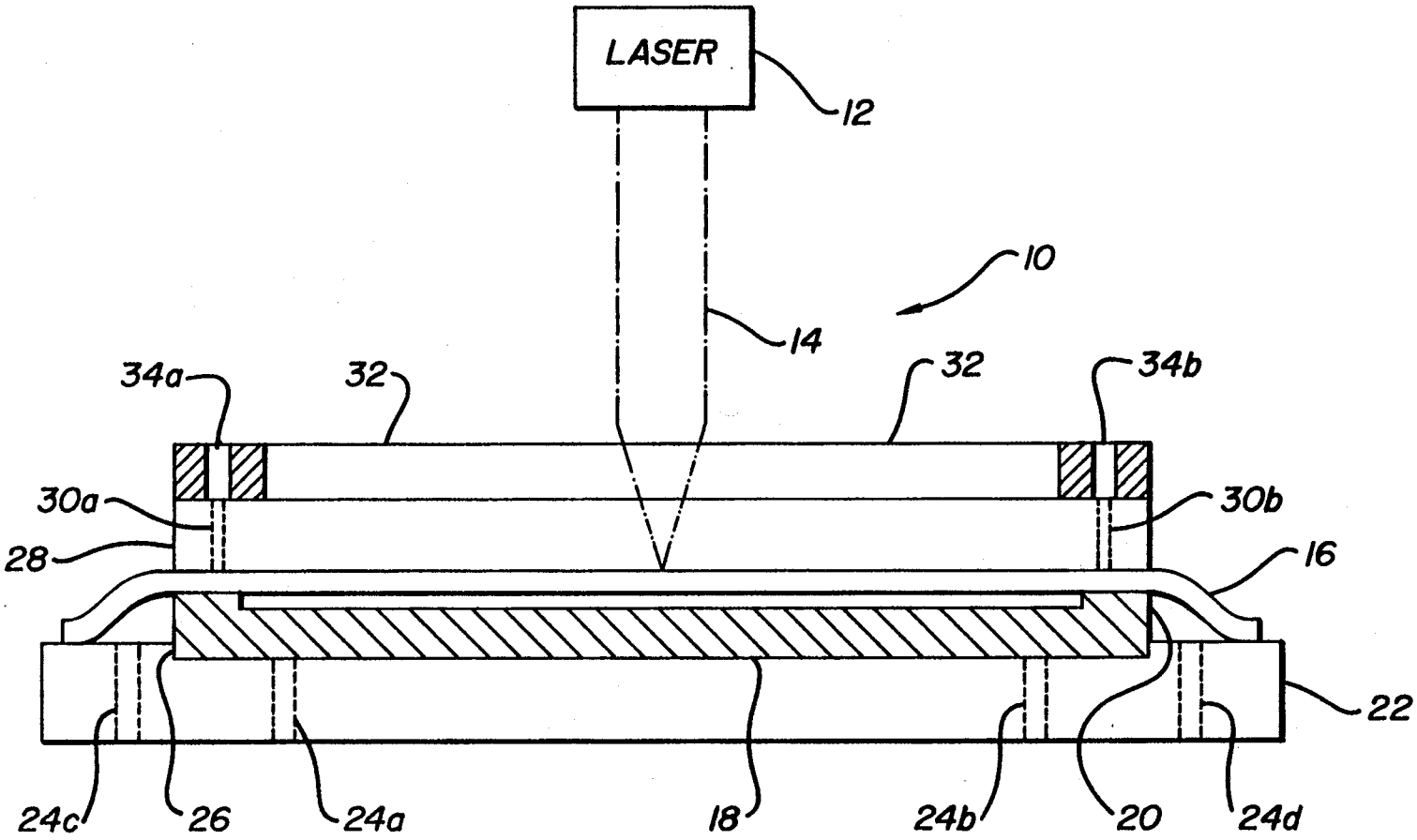
LASER
12
14
10
32
34b
30b
16
22
24d
20
24b
18
32
34a
30a
28
24a
26
24c

NONCONTACT DONOR AND RECEIVER HOLDER FOR THERMAL PRINTING

TECHNICAL FIELD OF THE INVENTION

The present invention relates generally to laser thermal printing, and, more particularly, to an apparatus and method for eliminating artifacts caused by spacer beads positioned between the donor and receiver to prevent the donor and receiver from sticking to one another.

BACKGROUND OF THE INVENTION

In a typical laser thermal printing system the donor and receiver elements are kept into close proximity to transfer dye from the donor element to the receiver element. The donor and receiver are close together but microspaced to prevent sticking between the donor and receiver, particularly when the microspace is evacuated to enhance the dye transfer efficiency. The microspace prevents impression of surface defects of the donor on the receiver. The microspace is maintained by coating a thin layer of matt beads on the donor or receiver surface. U.S. Pat. No. 4,772,582 discloses the use of beads to maintain spacing between the donor and receiver.

Although surface contact is virtually eliminated by coating a thin layer of matt beads on the donor or receiver, micro contacts, shadowing artifacts of matt beads, and artifacts due to scattering of light from the beads remain. Some post processing of the image, such as index matching of beads, lamination, high fusion, or other processing, may be required. Post processing contributes to a reduced modular transfer function (MTF) for the image. Accordingly, it will be appreciated that it would be highly desirable to eliminate matt beads as spacers between the donor and receiver elements and thereby eliminate image noise and artifacts caused by bead shadows.

SUMMARY OF THE INVENTION

The present invention is directed to overcoming one or more of the problems set forth above. Briefly summarized, according to one aspect of the invention, a laser thermal dye transfer apparatus comprises a dye receiving element having a ridge formed along a periphery thereof for receiving a dye donor element thereon with the only physical contact between the elements occurring along the ridge.

According to another aspect of the invention, a method for forming a laser induced thermal dye transfer comprises forming a ridge along a periphery of a dye receiving element, the dye receiving element having a support with a polymeric dye image receiving layer thereon contacting the ridge of the dye receiving element with at least one dye donor element with the dye donor element having a support with a dye layer thereon and an infrared absorbing material and with the dye donor and dye receiver being separated by a finite distance to create a space other than along the periphery, and heating the dye donor element by means of a laser and image-wise transferring a dye image to the dye receiving element to form a laser induced thermal dye transfer image.

The present invention maintains separation between the donor and receiver elements in laser thermal printing without beads. The gap is more controlled compared to a gap created with beads. The gap can be formed by forming ridges on donor or receiver by a variety of methods. The gap between the donor and receiver elements is independent of the donor and receiver element thickness variations. The environmental enclosure prevents artifacts due to dirt in the printing area.

These and other aspects, objects, features and advantages of the present invention will be more clearly understood and appreciated from a review of the following detailed description of the preferred embodiments and appended claims, and by reference to the accompanying drawing.

BRIEF DESCRIPTION OF THE DRAWING

The drawing is a diagrammatic sectional of a preferred embodiment of laser thermal printing apparatus with a dye donor and receiver holder in accordance with the present invention.

DETAILED DESCRIPTION OF THE PREFERRED EMBODIMENTS

Referring to the drawing, a laser thermal dye transfer apparatus 10 has a laser 12 that emits a beam of light 14. The beam 14 is directed toward a dye donor element 16 to transfer an image to a dye receiving element 18. The dye donor element 16 has a support with a dye layer thereon and an infrared absorbing material to absorb the light 14 from the laser 12 on a selective basis. The absorbed light heats the dye in the donor 16. The dye receiving element 18 has a support with a polymeric dye receiving layer thereon to receive dye sublimed from the donor 16 to create an image thereon in accordance with information contained in the beam 14.

A ridge 20 is formed along the periphery of the dye receiving element 18. The ridge 20 extends above the dye receiving layer and may be on top of the receiving layer or may be formed so that a portion of the receiving layer is on top of the ridge 20. The ridge 20 may be formed by embossing, coating, laser forming or mechanical shimming, and may be on the entire periphery or only portions of the periphery. The ridge 20 extends above the surface to receive the dye donor element 16 thereon with the only physical contact between the donor and receiver elements 16, 18 occurring along the ridge 20. This leaves the image area of the receiver 18 free for imaging.

The laser thermal dye transfer apparatus 10 includes a receiver holder or plate 22 that abuts the receiver 18 to hold the imaging area of the dye receiving element 18 flat for a high quality image. The holder 22 has at least one, and preferably a plurality, of openings or vacuum channels 24*a–d* formed therein. There may also be a recessed portion forming a shoulder 26 for accurately positioning the receiver 18. A vacuum pump (not shown) is connected through appropriate pipes or tubes to the openings 24*a–b* to create suction to attract the receiver 18 and hold the receiver 18 flat against the plate 22 during imaging. A separate pump (not shown) can be used to partially evacuate the space between the donor 16 and receiver 18 via vacuum channels 24*c–d*. The donor 16 is larger than the receiver 18 so that the donor 16 overhangs the receiver 18 and openings 24*c–d*, and contacts the holding plate 22 so that the partial evacuation can occur. The receiver 18 lies against the plate 22 with the polymeric dye receiving layer available for receiving sublimed dye with the ridge 20 available for receiving the dye donor element 16.

The laser thermal dye transfer apparatus 10 also includes a donor holder or plate 28 that abuts the donor 16 to hold the imaging area of the dye donor element 16 flat for a high quality image. The holder 28 is preferably a transparent glass plate that has at least one, and preferably a plurality, of openings or vacuum channels 30 formed therein. A vacuum pump (not shown) is connected through appropriate pipes or tubes to the openings 30 to create suction to attract the donor 16 and hold the donor 16 flat against the plate 28 during imaging. The donor 16 lies against the plate 28 with the dye layer available for subliming onto the dye receiving element 18.

Alternatively, a frame 32 may be used between the vacuum pump and glass plate 28. The frame 32 has openings or vacuum channels 34 alignable with the openings 30 in the glass plate 28, and also has vacuum channels for holding the glass plate. The frame 32 offers the advantages of ease of connection to the vacuum pump and convenience. Using the frame 32 makes handling the glass plate 28 easier.

Operation of the present invention is believed to be apparent from the foregoing description, but a few words concerning the method of the present invention will be added for emphasis. The method for forming a laser induced thermal dye transfer comprises the steps of forming a ridge along a periphery of a dye receiving element, contacting the ridge with a dye donor element, separating the donor and receiver elements by a finite distance, heating the donor by means of a laser and image-wise transferring a dye image to the dye receiving element to form a laser induced thermal dye transfer image. The method also includes creating a vacuum to hold the dye donor element flat against a holding plate, and creating a vacuum to hold the dye receiving element flat against a holding plate.

It can now be appreciated that there has been presented a method and apparatus that maintains microspacing between the donor and receiver elements without using beads, and, therefore, without any of the disadvantages and problems associated with matt beads. The donor sheet is held by the glass plate under vacuum. The glass plate has holes or channels for drawing a vacuum, and there is a vacuum port for connection to the vacuum pump. The plate can also be made of Pyrex, plastic or other material of sufficient optical quality. A handle can be attached to the plate for easily transporting the plate to and from donor pickup and drop-off stations.

The receiver element is positioned on a holder, and is also held by vacuum. The edges of the receiver are embossed, coated, laser formed or mechanically shimmed to form a ridge of predetermined dimension. The ridge so formed provides the specified gap between the donor and receiver. Because both receiver and donor elements assume the stiffness and flatness of their supporting plates, the gap is maintained. The dye transfer efficiency is known to vary with variation of gap, but the gap produced is independent of both the donor and receiver element thickness variations and is more controlled. A mechanical stop may also be used for the gap formation. The laser beam to heat the donor element is brought through the optically transparent glass plate.

While the invention has been described with particular reference to the preferred embodiments, it will be understood by those skilled in the art that various changes may be made and equivalents may be substituted for elements of the preferred embodiment without departing from invention. In addition, many modifications may be made to adapt a particular situation and material to a teaching of the invention without departing from the essential teachings of the present invention.

With the present invention there is no need to coat microbeads on either the donor or receiver elements, thereby reducing media cost. Because there are no beads, there are no image artifacts caused by bead shadows or light scattering from beads, thus providing better image quality. The gap can be maintained accurately and in a controlled manner because the donor and receiver elements assume the flat configuration of their holders. In addition, the enclosed environment created by placing the donor and receiver elements between the holders prevents dust on donor and receiver elements thereby producing better image quality without dirt artifacts.

As is evident from the foregoing description, certain aspects of the invention are not limited to the particular details of the examples illustrated, and it is therefore contemplated that other modifications and applications will occur to those skilled the art. It is accordingly intended that the claims shall cover all such modifications and applications as do not depart from the true spirit and scope of the invention.

What is claimed is:

1. A laser thermal dye transfer apparatus comprising a dye receiving element having a ridge formed along a periphery thereof for receiving a dye donor element thereon with the only physical contact between said dye donor and dye receiving elements occurring along said ridge.

2. An apparatus, as set forth in claim 1, including a receiver holder abutting said receiver to hold said dye receiving element flat.

3. An apparatus, as set forth in claim 2, including means for creating a vacuum to attract said dye receiving element towards said receiver holder.

4. An apparatus, as set forth in claim 1, including a donor holder abutting said donor to hold said dye donor element flat.

5. An apparatus, as set forth in claim 4, including means for creating a vacuum to attract said dye donor element towards said donor holder.

6. A laser thermal dye transfer apparatus, comprising:

a dye donor holder for holding a dye donor element flat against a surface of said dye donor holder a dye receiver element having a ridge formed along a periphery thereof;

a dye receiver holder for holding a dye receiver element flat against a surface of said dye receiver holder with said ridge facing said dye donor holder to receive said dye donor element with the only physical contact between said donor and receiver occurring along said ridge.

7. An apparatus, as set forth in claim 6, wherein said donor is larger than said receiver and overhangs said receiver.

8. An apparatus, as set forth in claim 6, wherein said donor and receiver each contain an image area, and wherein said image areas are free of physical contact.

9. A method for forming a laser induced thermal dye transfer comprising:

forming a ridge along a periphery of a dye receiving element, said dye receiving element having a support with a polymeric dye image receiving layer thereon;

contacting said ridge of said dye receiving element with at least one dye donor element, said dye donor element having a support with a dye layer thereon and an infrared absorbing material, said dye donor and dye receiver being separated by a finite distance to create a space other than along said periphery; and heating said dye donor element by means of a laser and image-wise transferring a dye image to said dye receiving element to form a laser induced thermal dye transfer image.

10. A method, as set forth in claim 9, including creating a vacuum to hold said dye donor element flat against a holding plate.

11. A method, as set forth in claim 9, including creating a vacuum to hold said dye receiving element flat against a holding plate.

* * * * *